United States Patent [19]

De Donno

[11] 4,235,439

[45] Nov. 25, 1980

[54] FRICTION TYPE EXERCISING DEVICE

[75] Inventor: Benito De Donno, North Vancouver, Canada

[73] Assignee: Super Stretch Co., Ltd., West Vancouver, Canada

[21] Appl. No.: 40,503

[22] Filed: May 21, 1979

[51] Int. Cl.[3] ..... A63B 21/22

[52] U.S. Cl. ..... 272/132; 188/75; 73/379; 272/DIG. 5

[58] Field of Search ..... 272/132, 129, 116, 125, 272/DIG. 3, DIG. 4, DIG. 6, 128, 131, 134, 144, DIG. 5; 92/84; 73/39, 379; 242/129.8, 147 R, 99; 273/DIG. 21; 188/75, 83

[56] References Cited

U.S. PATENT DOCUMENTS

| | | | |
|---|---|---|---|
| 3,610,617 | 10/1971 | Hepburn | 272/132 |
| 3,690,654 | 9/1972 | Hepburn | 272/132 |
| 3,764,132 | 10/1973 | Hepburn | 272/132 |
| 4,138,106 | 2/1979 | Bradley | 272/132 |
| 4,148,478 | 3/1979 | Myski | 272/132 |

FOREIGN PATENT DOCUMENTS

| | | | |
|---|---|---|---|
| 1217328 | 12/1970 | United Kingdom | 272/132 |

*Primary Examiner*—Richard C. Pinkham

*Assistant Examiner*—T. Brown

*Attorney, Agent, or Firm*—Fulwider, Patton, Rieber, Lee & Utecht

[57] ABSTRACT

An exercising device comprises a base member, a shaft rotatably mounted within the base member and a pulley mounted on each end of the shaft. There are free-wheels engaging the pulleys and the shaft for rotation in one direction and permitting the pulleys to rotate freely about the shaft for rotation in the opposite direction. There is a spring for rotating the pulleys in the opposite direction. A cable is connected to each pulley to rotate the pulleys in the one direction when the cables are pulled away and unwound from the pulleys. There are first and second brake shoes with recesses for the shaft. Hinges are connected to the brake shoes to one side of the shaft and urge the brake shoes against the shaft. Levers are connected to the brake shoes and extend to a side of the shaft opposite the one side. There is a knob for adjustably urging the first brake shoe against the shaft and a hydraulic cylinder and piston for measuring the force exerted by the shaft against the second brake shoe. There is a dial for indicating the fluid pressure within the cylinder. The dial is calibrated to read the force exerted upon the cables to rotate the pulleys in the one direction.

10 Claims, 6 Drawing Figures

FRICTION TYPE EXERCISING DEVICE

BACKGROUND OF THE INVENTION

This invention relates to an exercising device.

Exercising devices using frictional resistance against the pull of cables are known in the prior art. For example, devices of this general type are found in U.S. Pat. Nos. 3,610,617; 3,690,654; and 3,764,132, all to Hepburn.

In U.S. Pat. No. 3,610,617, the two cables are each connected to a pulley and each pulley is mounted on a separate shaft. The frictional force on the shafts is achieved by tightening leather strips against the shaft. There is a knob connected to a bolt which threadedly engages a lower wooden block. By turning the knob, the lower block is tightened against an upper wooden block. The leather strips are located between the blocks and the shafts. This arrangement has certain disadvantages. For example a considerable force must be exerted on the knob for higher resistances against the pulling of the cables. A scale is provided to show the position of the knob and this is supposed to represent the upwards force exerted on the cables. However, the scale may not be accurate since the friction between the leather strips and the shafts varies as the leather strips compress or wear and varies with the lubrication between the leather and the shaft.

The device shown in U.S. Pat. No. 3,690,654 is similar to the device disclosed in the patent discussed above except that the cables are wound on the pulleys so as to alternately rotate the shaft in opposite directions.

In U.S. Pat. No. 3,764,132, a knob at one end of the housing of the device urges a pair of brake shoes against the shaft through an arrangement of wedges.

SUMMARY OF THE INVENTION

An exercising device comprises a base member; a shaft rotatably mounted within the base member; and a pulley mounted on each end of the shaft. There is means for engaging the pulleys and the shaft when the pulleys are rotated in one direction and for permitting free rotation of the pulleys about the shaft when the pulleys are rotated in an opposite direction to the one direction. Resilient means is connected to the pulleys and biases the pulleys to rotate in said opposite direction. A cable is connected to each pulley to rotate the pulleys in the one direction when the cables are pulled away and unwound from the pulleys. First and second brake shoes each have a shaft receiving recess, the shaft being between the recesses of the brake shoes. Hinge means to one side of the shaft urges each said brake shoe against the shaft. First and second levers are connected to the first and second brake shoes respectively and extend to a side of the shaft opposite the one side. Adjustable means connects the first lever to the base member for adjustably urging the first brake shoe against the shaft. Load measuring means, connecting the second lever to the base member, measures a force exerted by the shaft against the second brake shoe. There is indicating means for indicating the force measured by the load measuring means.

When compared to the prior art, embodiments of the present invention offer distinct advantages. For example, because the knob for adjusting the frictional force is connected to a lever, the resulting mechanical advantage means of the knob for adjusting the friction force can be turned easily although the frictional force is set quite high. More importantly, the force or tension in the cables can be set much more accurately than with prior art devices. A hydraulic cylinder and piston in combination with a hydraulic pressure gauge, or some other type of load cell, indicates the force between the brake shoes and the shaft. With a relatively constant coefficient of friction, this value can be converted easily into the tension on the cable and the dial on the device can be correspondingly calibrated. In some prior art devices, the force on the shaft is not actually measured, but merely indicated by the position of the knob which sets the frictional force. Since the position of the knob changes from time to time for the same frictional force, these prior art devices cannot measure the tension in the cables as accurately as can an embodiment to the present invention.

DESCRIPTION OF THE PREFERRED EMBODIMENTS

Figure 1:
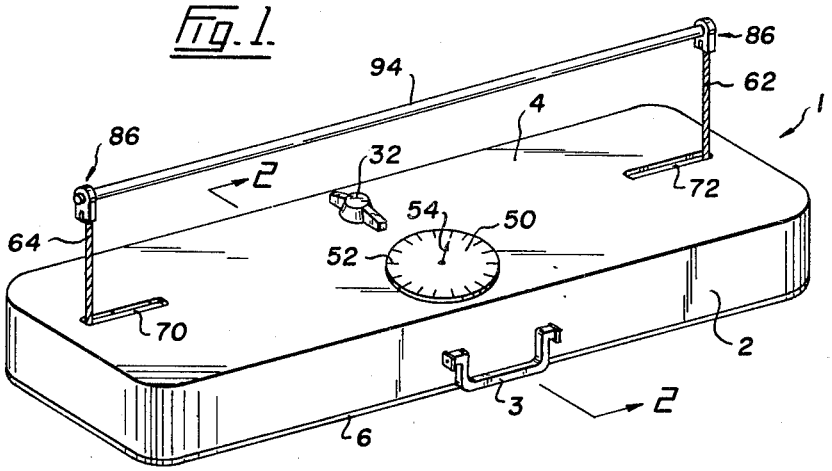
FIG. 1 is an isometric view of an exercising device according to an embodiment of the invention, showing the top and front thereof.

The exercising device 1 shown in the drawings is a relatively compact unit which can be used for many exercises and simulates the function of both barbells and dumbbells of various weights. The device 1 includes a base member 2 comprising a downwardly opening hollow housing with a handle 3 and rectangular top 4. As seen best in FIG. 2, a rectangular bottom cover 6 is screwed onto the bottom of the base member.

Within the base member 2, a shaft 8 is rotatably mounted between a first, or lower, brake shoe 12 and a second, or upper, brake shoe 10. The upper brake shoe 10 has an elongate, concave brake lining 14 comprising a shaft receiving recess extending along the entire length of the brake shoe. The lower brake shoe 12 has a similar brake lining 15. The brake linings 14 and 15 are of the usual asbestos-based material with a suitable solid lubricant. The shaft 8 is between the brake linings 14 and 15. There are two upwardly extending lugs 16 near each end of upper brake shoe 10 which form an integral part of the brake shoe. Four corresponding downwardly extending lugs 17 of housing 2 have notches 19 for receiving the top corners of lugs 16. Lugs 16 and 17 provide hinge means to one side of the shaft 8 urging upper brake shoe 10 downwardly against the shaft 8. Two downwardly extending bolts 18 are connected to the top 4 of the base member 2 at their upper ends 20 and each passes slidably through corresponding apertures 22 and 24 of the upper brake shoe 10 and lower brake shoe 12 respectively. A pair of nuts 26 are threadedly received at the bottom end of each bolt 18 below lower brake shoe 12. The two bolts 18 and the nuts 26 provide hinge means to the one side of shaft 8 urging the lower brake shoe 12 upwardly against the shaft 8.

A first, or lower lever 30 forms an integral part of lower brake shoe 12 and extends to a side of shaft 8 opposite the one side of rods 16 and 17 bolts 18. Similarly, a second, or upper, lever 28 forms an integral part of the upper brake shoe 10 and extends to the same side of shaft 8 as lever 30.

A knob 32, located on the top 4 of the base member 2, is connected to a downwardly extending shaft 34 which extends rotatably through aperture 36. Shaft 34 passes rotatably through aperture 38 of lower lever 30 and is threadedly received by a nut 40 which is received in slot 41 on the bottom of lever 30. The elongate nature of slot 41 and the convex surface 43 on the bottom of lever 30 permit movement between nut 40 and lever 30 when knob 32 is turned to pivot the lever. However, slot 41 prevents nut 40 from rotating when knob 32 is turned. By rotating knob 32, adjustble means is provided for connecting the first lever 30 to the base member 2 for adjustably urging the lower brake shoe 12 against the shaft 8.

Figure 2:
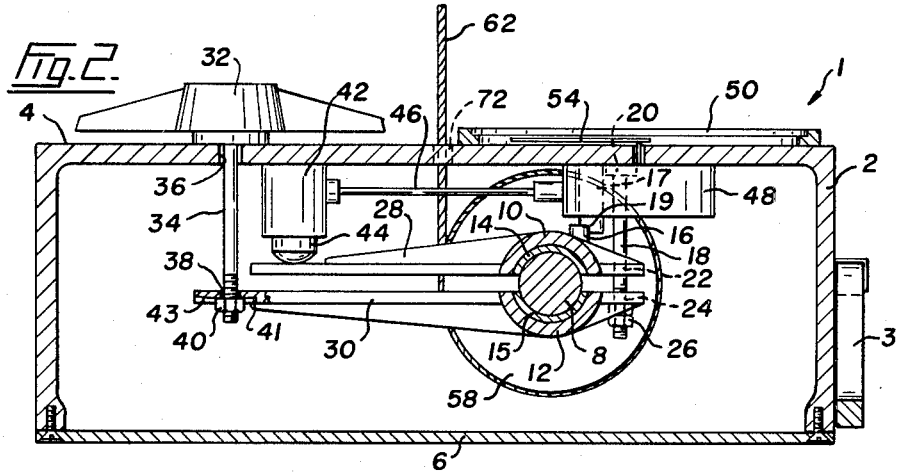
FIG. 2 is sectional view taken along line 2—2 of FIG. 1.

There is a combination hydraulic cylinder 42 and piston 44 interposed between the interior of top 4 of the base member 2 and the upper lever 28. As shown in FIG. 2, the piston 44 projects downwardly from the cylinder and has a rounded bottom end for contacting lever 28. The pressure of the hydraulic fluid within cylinder 42 is proportional to the upward force exerted by lever 28 against piston 44 and this force is proportional to the upward force of shaft 8 against upper brake shoe 10. Consequently, the cylinder 42 and piston 44 provide means for measuring the force exerted by the shaft 8 against the brake shoe 10. A hydraulic fluid line 46 connects cylinder 42 to hydraulic pressure gauge 48 which has a dial 50 on the top 4 of the base member 2. The pressure gauge 48 provides indicating means for indicating the pressure of hydraulic fluid within cylinder 42 and, consequently, the upward force of shaft 8 against upper brake shoe 10. Dial 50 has a scale 52 calibrated in units of force, such as pounds and kilograms, and an indicator needle 54.

Besides cylinders 42 and dial 50, other means could be employed for measuring and indicating the force exerted by shaft 8 on brake shoe 10. For example, mechanical, electrical or electronic load cells could be used.

A pair of pulleys 56 and 58 are mounted on each end of the shaft 8. The pulleys 56 and 58 are mirror images of each other and the details of pulley 58 are shown more clearly in FIG. 4. Pulley 58 has a peripheral, helical groove 60 for receiving a cable 62, while pulley 56 has a similar groove for receiving the cable 64. Each pulley is mounted on the shaft 8 by means of needle bearings 66, 67 and 69 and a free-wheel 68. In the well known manner, the free-wheels 68 engage when the pulleys 56 and 58 are rotated in one direction and permit free rotation between the pulleys and shaft 8 when the pulleys are rotated in the opposite direction. In this way, free-wheels 68 provide means for engaging the pulleys 56 and 58 and the shaft 8, when the pulleys are rotated in one direction, as cables 62 and 64 are pulled upwardly away from the pulleys through apertures 70 and 72 in base member 2 and unwound from the pulleys. However, when the pulleys are rotated in the opposite direction, free-wheels 68 permit free rotation between the pulleys 56 and 58 and the shaft 8.

Figure 3:
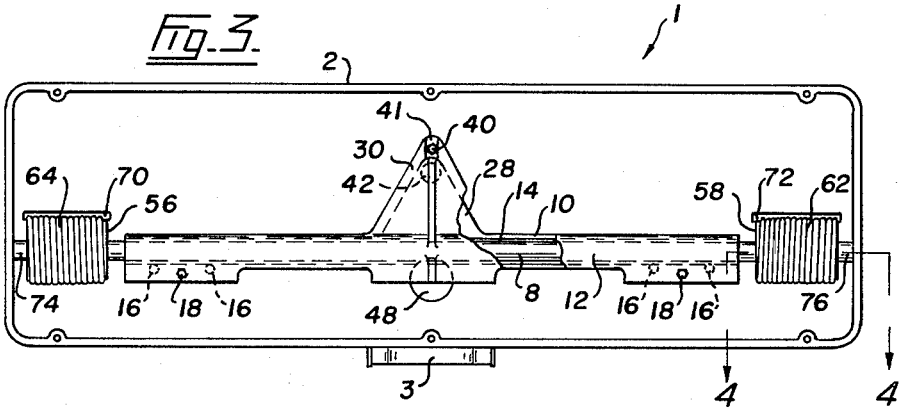
FIG. 3 is a bottom plan view, partly broken away, of the exercising device with the bottom cover removed.
Figure 4:
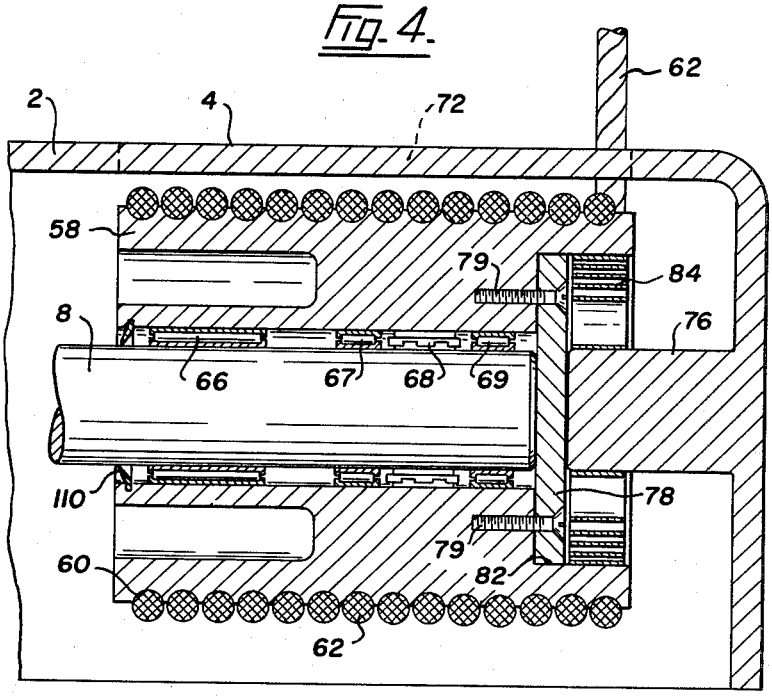
FIG. 4 is a sectional view of one of the pulleys of the device taken along line 4—4 of FIG. 3.

As seen in FIG. 3, and in more detail in FIG. 4, base member 2 has a pair of projections 74 and 76 which extend inwardly towards the ends of shaft 8. Each of the pulleys 56 and 58 has a nylon disc 78 fastened to the pulley by a plurality of screws 79 and located within a cylindrical recess 82 of each pulley adjacent an end of shaft 8. Each disc 78 fits between the end of the shaft and one of the projections 74 or 76 to provide a thrust bearing for shaft 8. Projections 74 and 76 and disc 78 also prevent the pulleys 56 and 58 from rubbing against the base member 2.

A spiral spring 84 is located within the cylindrical recess 82 of each pulley outwardly from the disc 78. Springs 84 have an outer end connected to one of the pulleys 56 or 58 and an inner end connected to one of the projections 74 or 76. Spiral springs 84 provide resilient means connected to the pulleys 56 and 58 and biasing the pulleys to rotate in a direction for winding cables 62 and 64 onto the pulleys.

Figure 5:
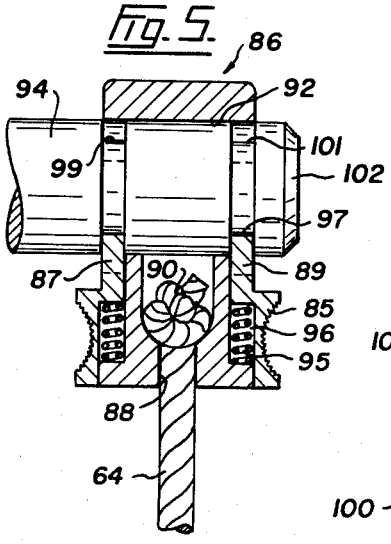
FIG. 5 is an enlarged fragmentary view of one end of the bar connected to the cables in FIG. 1, with one of the connecting collars shown in section.
Figure 6:
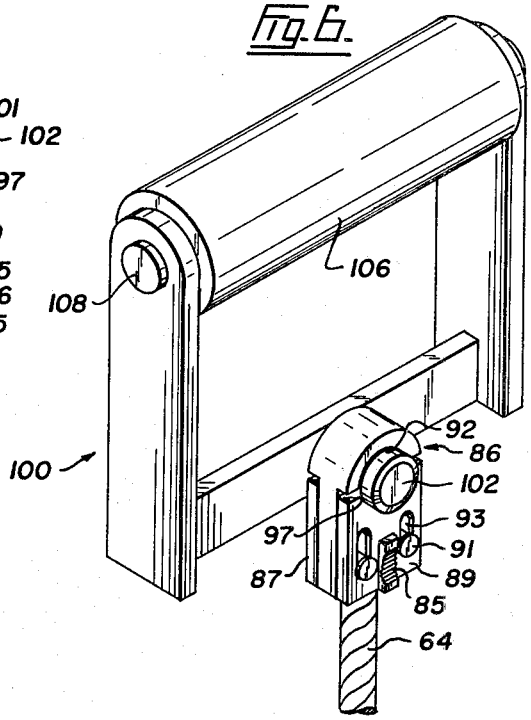
FIG. 6 is an isometric view of an alternative handle for connecting to each of the cables of FIG. 1.

As shown in FIG. 1, FIG. 5 and FIG. 6, a collar member 86 is connected to the end of cables 62 and 64 by passing the end of each cable through an aperture 88 of each collar member and providing a knot 90 on the end of each cable within the collar member. Each collar member 86 has an aperture 92 for receiving one end of bar 94. There are two slidable plates 87 and 89 to each side of collar members 86 which are connected to the collar members by pins 91 passing through the elongate apertures 93 of the plates. Each plate has a thumb grip 85 and a coil spring 95 is compressed within the recess 96 formed between each plate 87 and 89 and collar member 86. Springs 95 bias plates 87 and 89 towards bar 94 so the upper convex edges 97 of plates 87 and 89 engage annular recesses 99 and 101 of bar 94. Collar members 86 connect cables 62 and 64 to bar 94, but permit rotation of the bar during exercises. Downward pressure on thumb grips 85 disengages plates 87 and 89 from recesses 99 and 101 and permits collar members 86 to be removed from bar 94.

Alternatively, separate handle members 100 can be fitted to each of the cables 62 and 64. The collar member 86 of each of the cables is fitted rotatably over the short shaft 102 of each handle member in the same manner as the collar members are connected to each end of bar 94. Each handle member 100 has a cylindrical handle 106 rotatably connected to the handle member on a shaft 108.

Bar 94 is connected to the two cables 62 and 64 to simulate the use of a barbell, while two handle members 100 are used to simulate the use of two dumbbells. The user simply stands on the base member 2 and grasps either the bar 94 or the two handles 106. When the bar 94 or handles 106 are pulley upwardly, cables 62 and 64 are pulled away from, and unwound from, pulleys 58 and 56 respectively. In this direction of rotation, free-wheels 68 engage so that the pulleys 56 and 58 rotate the shaft 8. The linings 14 and 15 of the brake shoes 10 and 12 provide a frictional force against the rotation of shaft 8. This force is adjusted by knob 32 to equal the "weight" which the person desires to lift. Since knob 32 is connected to lever 30, rather than being connected directly to the brake shoe 12, knob 32 is considerably more easy to rotate to adjust the desired frictional force than in prior art devices.

When knob 32 is rotated to pull lever 30 and brake shoe 12 upwardly, the shaft 8 is pushed upwardly against brake shoe 10. This urges lever 28 against piston 44 and pressure gauge 48 indicates the fluid pressure within cylinder 42. By properly calibrating the scale 52 on the dial 50, needle 54 indicates the upward force against cables 62 and 64 required to overcome the frictional force of brake shoes 10 and 12. The user simply rotates knob 32 until arrow 54 indicates the proper force in pounds or kilograms.

The user lifts up on bar 94 or handle 106 until cables 62 and 64 are extended the desired distance. He then permits bar 94 or handles 106 to move downwardly. This permits the spiral springs 84 to rotate pulleys 56 and 58 so as to rewind cables 62 and 64 on the helical grooves 60. Free-wheels 68 permit free rotation of the pulleys 56 and 58 about shaft 8 during the rewinding of the cables.

Because pressure gauge 48 indicates the force or tension required to unwind cables 62 and 64 by means of the frictional force of brake shoes 10 and 12, the reading is not affected by wear of the linings 14 and 15 of the brake shoes.

Since the exercising device uses a single shaft 8, the frictional resistance against the unwinding of cable 62 is always the same as that of cable 64 and corresponds to the reading of dial 50. In devices where a separate rotatable member is used for each pulley, the dial reads, at best, only the sum of the pulling force of the two cables and not that of a single cable.

The free-wheels 68 are preferable to the pawls engaging in slots cut into the shafts which are used on some prior art exercising devices. The prior art arrangement permits engagement of the pulleys and shaft only at certain intervals. This is undesirable, especially in the performance of exercises requiring only short extension of the cables, where engagement at any point would be more convenient.

The use of the nylon disc 78 as a thrust bearing avoids a problem found in some prior art exercising devices. In prior art devices using two separate rotating members for the pulleys, the two ends of the clamping block lift slightly when the central bolt is turned tightly. When this happens, the passage in which the two rotatable members turn is defomed and causes the two rotatable members to move outwardly from the central bolt. In the case of the present invention, the side thrust of shaft 8 against the pulleys 56 and 58 and the rubbing of the pulleys against the base member 2 are both stopped by the discs 78. In addition, together with rotary lip seal 110 near the needle bearing 66, the lubricant required for needle bearings 66, 67 and 69 and free-wheels 68 is retained and will not contaminate the brake linings 12 and 14. In some prior art devices, lubricant can contaminate the braking surfaces, affecting the frictional force on the shaft and the accuracy of the dial reading. Additionally, contamination of the brake linings means they must be replaced from time to time.

In the embodiments of the invention described above, the collar members 86 are rotatably connected to the bar 94 and to each of the handle members 100. Moreover, handles 106 of the handle members 100 are rotatable about axles 108. This permits free movement of the bar 94 or handles 106 without damaging the cable, even under heavy loads. These features are not found on some prior art devices.

What I claim is:

1. An exercising device comprising:

a base member;

a shaft rotatably mounted within the base member;

a pulley mounted on each end of the shaft;

means for engaging the pulleys and the shaft, when the pulleys are rotated in one direction, and for permitting free rotation of the pulleys about the shaft when the pulleys are rotated in an opposite direction to the one direction;

resilient means connected to the pulleys and biasing the pulleys to rotate in said opposite direction;

a cable connected to each pulley to rotate the pulleys in the one direction when the cables are pulled away from and unwound from the pulleys;

first and second brake shoes, each said brake shoe having a shaft receiving recess, the shaft being between the recesses of the brake shoes;

hinge means to one side of the shaft and urging each said brake shoe against the shaft;

first and second levers connected to the first and second brake shoes respectively and extending to a side of the shaft opposite the one side of the shaft;

adjustable means connecting the first lever to the base member for adjustably urging the first brake shoe against the shaft;

load measuring means connecting the second lever to the base member for measuring a force exerted by the shaft against the second brake shoe; and indicating means for indicating the force measured by the load measuring means.

2. A device as claimed in claim 1, the load measuring means comprising a hydraulic cylinder and piston interposed between the base member and the second lever, the force exerted by the shaft against the second brake shoe causing a deflection of the piston and pressurizing hydraulic fluid in the cylinder.

3. A device as claimed in claim 2, the indicating means comprising a hydraulic pressure gauge connected to said cylinder for measuring the pressure of the hydraulic fluid in the cylinder.

4. A device as claimed in claim 3, the base member having a top, the pressure gauge having a dial on the top of the base member and calibrated to read the force exerted on the cables to rotate the shaft in the one direction.

5. A device as claimed in claim 4, the adjustable means comprising a knob on the top of the base member connected to a shaft extending rotatably through the base member with a threaded end received within a corresponding nut connected to the first lever.

6. A device as claimed in claim 5, the first brake shoe being below the shaft and the second brake shoe being above the shaft, when the device is positioned for use.

7. A device as claimed in claim 1, the base member having a top, the adjustable means comprising a knob on the top of the base member connected to a shaft extending rotatably through the base member with a threaded end received within a corresponding nut connected to the first lever.

8. A device as claimed in claim 1, the means for engaging the pulleys and for permitting free rotation of the pulleys comprising a free-wheel.

9. A device as claimed in claim 1, comprising brake linings connected to the brake shoes within said recesses for frictionally engaging the shaft.

10. A device as claimed in claim 9, each said brake lining having an elongate, concave surface for engaging the shaft.

* * * * *